US006495759B1

(12) United States Patent
Yamamoto et al.

(10) Patent No.: US 6,495,759 B1
(45) Date of Patent: Dec. 17, 2002

(54) TWO-CORE PARALLEL EXTRA-FINE COAXIAL CABLE

(75) Inventors: Yuuki Yamamoto, Ibaraki (JP); Satoshi Ueno, Ibaraki (JP); Hiroo Tanaka, Ibaraki (JP)

(73) Assignee: Hitachi Cable, Ltd., Tokyo (JP)

( * ) Notice: Subject to any disclaimer, the term of this patent is extended or adjusted under 35 U.S.C. 154(b) by 0 days.

(21) Appl. No.: 09/956,249

(22) Filed: Sep. 20, 2001

(30) Foreign Application Priority Data

Jul. 5, 2001 (JP) ..... 2001-204701

(51) Int. Cl.[7] ..... H01B 7/00
(52) U.S. Cl. ..... 174/106 R; 174/113 R
(58) Field of Search ..... 174/106 R, 113 R, 174/109, 108, 36

(56) References Cited

U.S. PATENT DOCUMENTS 3,586,751 A * 6/1971 Schoerner ..... 174/113 R
4,691,081 A * 9/1987 Gupta et al. ..... 174/105 R
4,847,448 A * 7/1989 Sato ..... 174/103

* cited by examiner

*Primary Examiner*—Chau N. Nguyen
(74) *Attorney, Agent, or Firm*—Foley & Lardner

(57) ABSTRACT

It is an object of the present invention to provide a two-core parallel extra-fine coaxial cable having a high shield effect and sufficient flexibility for being wired in a narrows pace. To achieve the object, the invention provides a two-core parallel extra-fine coaxial cable including, two parallel cores having inner conductors whose outer peripheries are coated with insulations, a transversely wound shield provided around outer peripheries of the two cores, a composite tape which includes a plastic tape formed on its one surface with a metal deposition layer and which is wound around an outer periphery of the transversely wound shield such that the metal deposition layer comes on the side of the transversely wound shield, and a jacket for coating an outer periphery of the composite tape.

10 Claims, 4 Drawing Sheets

TWO-CORE PARALLEL EXTRA-FINE COAXIAL CABLE

BACKGROUND OF THE INVENTION

1. Field of the Invention

The present invention relates to a two-core parallel extra-fine coaxial cable having two parallel cores including inner conductors whose outer peripheries are coated with insulations, and more particularly, to a two-core parallel extra-fine coaxial cable having high shield effect and flexibility.

2. Prior Art

Generally, in a coaxial cable, in order to enhance the shield effect, a metal volume (shield volume) is increased using a technique in which an outer shield is formed into a braiding shield or double shield. The same is applied to the two-core parallel extra-fine coaxial cable having two parallel cores including inner conductors whose outer peripheries are coated with insulations.

An example of the two-core parallel extra-fine coaxial cable is a cable in which two cores are arranged in parallel, outer peripheries thereof are provided with braiding shield as outer shield, a composite tape formed with a copper deposition layer having a thickness of 0.1 $\mu$m or more is wound around the outer periphery of the braiding shield such that the copper deposition layer comes on the side of the braiding shield.

When the cable is wired in a narrow space such as a hinge portion of a notebook personal computer, it is required that the cable has flexibility and a diameter of the cable is fine. Since a notebook personal computer of recent year is used in high frequency region of 10 $MH_2$ or more, a two-core parallel extra-fine coaxial cable using a braiding shield having high shield effect is used as an outer shield is preferably employed.

In the case of the braiding shield, however, the flexibility of the cable is extremely poor because of the metal volume, there is a problem that a finished outer diameter of the cable is slightly thick.

To solve this problem, in the two-core parallel extra-fine coaxial cable, there is a method in which the braiding shield is changed into a transversely wound shield. That is, this is a method in which a plurality of shield strands are wound spirally around outer peripheries of two cores at a predetermined pitch.

However, when the outer shield is only the transversely wound shield, since a continuous slit exists between the shield strands, there is a problem that the shield effect is largely deteriorated.

Further, if the pitch of the transversely wound shield is large, the continuous slit becomes large, the shield effect is deteriorated, and if the transversely wound shield pitch is small, the slit becomes small but there is a problem that the kink is generated in the cable itself by tension of the shield strand when it is produced.

SUMMARY OF THE INVENTION

Thereupon, it is an object of the present invention to provide a two-core parallel extra-fine coaxial cable having high shield effect and having such a sufficient flexibility that the cable is wired in a narrow space.

The present invention has been accomplished to achieve the above object, and a first aspect of the invention provides a two-core parallel extra-fine coaxial cable comprising, two parallel cores having inner conductors whose outer peripheries are coated with insulations, a transversely wound shield provided around outer peripheries of the two cores, a composite tape which comprises a plastic tape formed on its one surface with a metal deposition layer and which is wound around an outer periphery of the transversely wound shield such that the metal deposition layer comes on the side of the transversely wound shield, and a jacket for coating an outer periphery of the composite tape.

According to a second aspect of the invention, in the first aspect, an outer diameter of the inner conductor of the core is about 0.13 mm or less, an outer diameter of the core is 0.45 mm or less, and an outer diameter of the cable when coated with the jacket is 1.0 mm or less.

According to a third aspect of the invention, in the first or second aspect, a transversely winding pitch of the transversely wound shield is set in accordance with the following equation:

$$10 \leqq (\text{transversely winding pitch})/\{(\text{outer diameter of one of said cores})\times 2+(\text{diameter of a transversely wound strand})\} \leqq 20.$$

According to a fourth aspect of the invention, in any of the first to third aspects, the transversely wound shield is formed by winding 30 to 60 strands comprising any of a soft copper wire, a tinned soft copper wire and a silver plated copper alloy wire around the outer peripheries of the two parallel cores.

According to a fifth aspect of the invention, in any of the first to fourth aspects, a diameter of each of strands forming the transversely wound shield is about 0.03 mm.

According to a sixth aspect of the invention, in any of the first to fifth aspects, the metal deposition layer formed on the composite tape is made of silver or copper, and a thickness of the metal deposition layer is 0.1 $\mu$m or more.

According to a seventh aspects of the invention, there is provided a two-core parallel extra-fine coaxial cable comprising, two parallel cores having inner conductors whose outer peripheries are coated with insulations, a transversely wound shield provided around outer peripheries of the two cores, a composite tape which comprises a plastic tape formed on its opposite surfaces with metal deposition layers and which is wound around an outer periphery of the transversely wound shield such that the metal deposition layers come on the side of the transversely wound shield, and a jacket for coating an outer periphery of the composite tape.

According to an eighth aspects of the invention, in the seventh aspect, an outer diameter of the inner conductor of the core is about 0.13 mm or less, an outer diameter of the core is 0.45 mm or less, and an outer diameter of the cable when coated with the jacket is 1.0 mm or less.

According to a ninth aspect of the invention, in the seven or eighth aspect, a transversly winding pitch of the transversly wound shield is set in accordance with the following equation:

$$10 \leqq (\text{transversly winding pitch})/\{(\text{outer diameter of one of said cores})\times 2+(\text{diameter of a transversly wound strand})\} \leqq 20.$$

According to a tenth aspect of the invention, in any of the seventh to ninth aspects, the transversely wound shield is formed by winding 30 to 60 strands comprising any of a soft copper wire, a tinned soft copper wire and a silver plated copper alloy wire around the outer peripheries of the two parallel cores.

According to an eleventh aspect of the invention, in any of the seventh to tenth aspects, a diameter of each of strands forming the transversely wound shield is about 0.03 mm.

According to a twelfth aspect of the invention, in any of the seventh to eleventh aspects, the metal deposition layer formed on the composite tape is made of silver or copper, and a thickness of the metal deposition layer is 0.1 μm or more.

DESCRIPTION OF THE PREFERRED EMBODIMENTS

Preferred embodiments of the present invention will be explained below with reference to the accompanying drawings.

Figure 1:
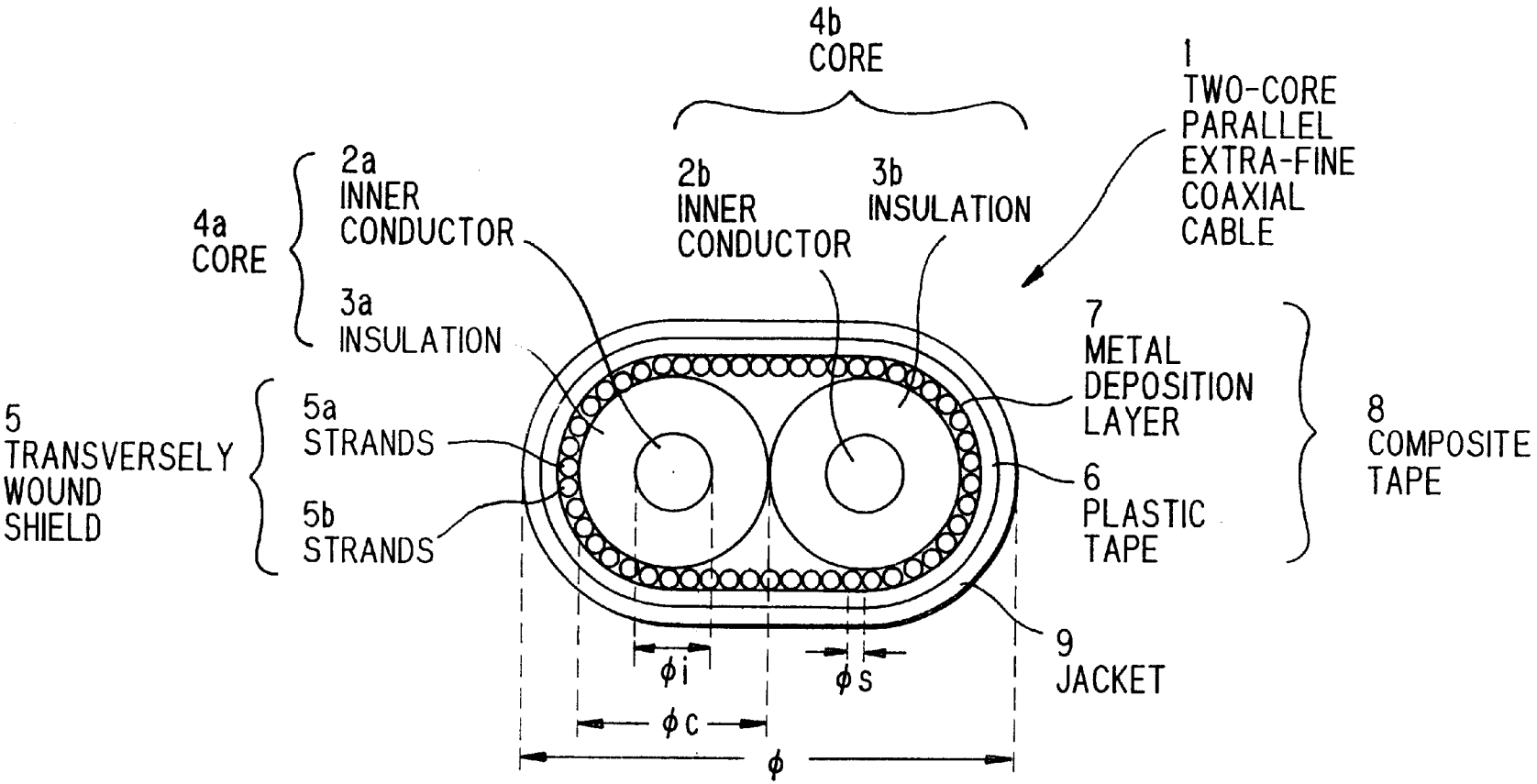
FIG. 1 is a sectional view showing a preferred embodiment of the present invention.
Figure 2:
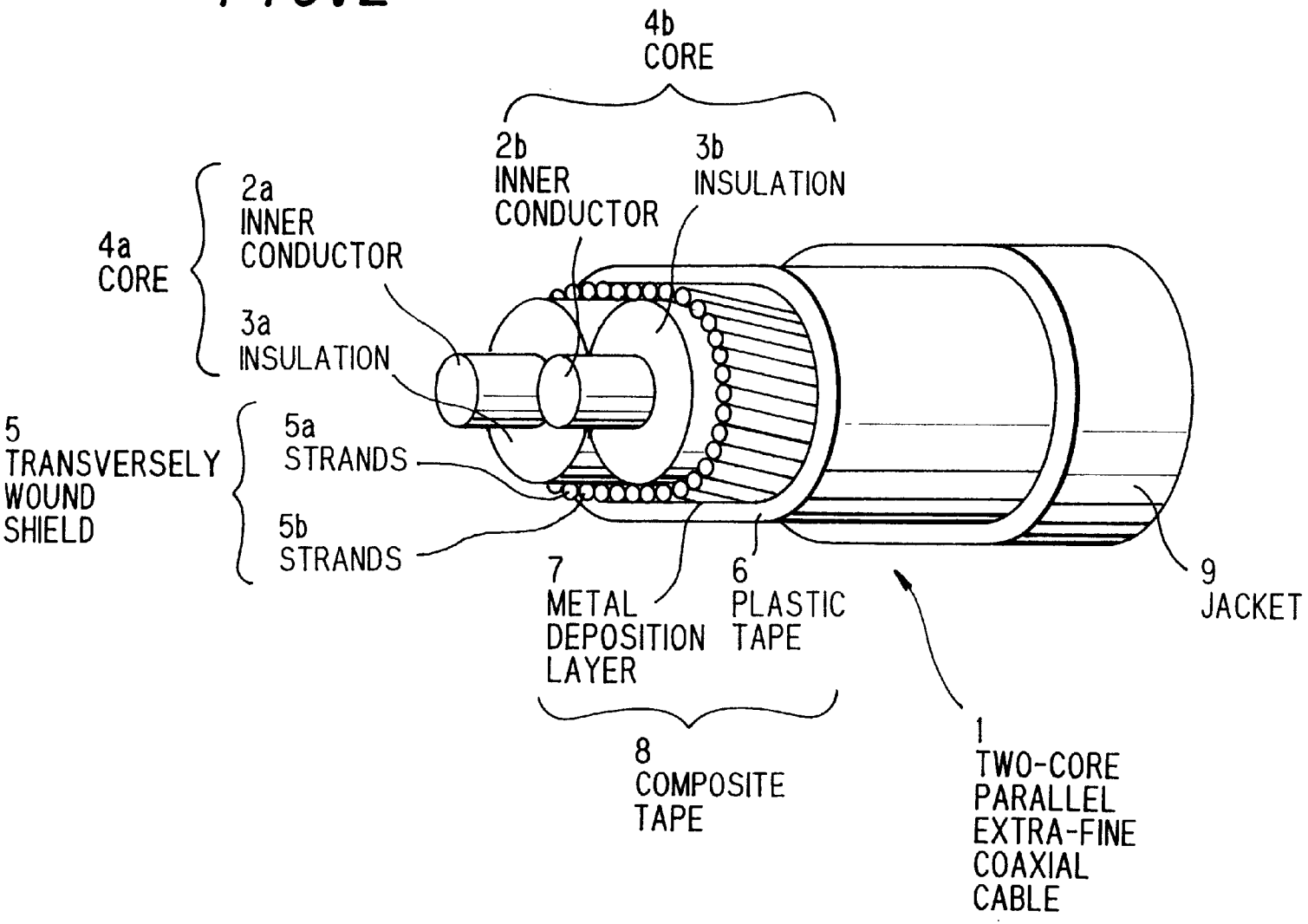
FIG. 2 is a view showing a structure of a two-core parallel extra-fine coaxial cable shown in FIG. 1.

FIG. 1 is a sectional view of a two-core parallel extra-fine coaxial cable which is a preferred embodiment of the invention, and FIG. 2 is a view showing a structure of the two-core parallel extra-fine coaxial cable shown in FIG. 1.

As shown in FIGS.1 and 2, the two-core parallel extra-fine coaxial cable 1 of the invention is used as a cable wired in a narrow space such as a hinge portion of a notebook personal computer for example. More specifically, the two-core parallel extra-fine coaxial cable 1 is for connecting a notebook personal computer and a liquid crystal display through a hinge portion.

The two-core parallel extra-fine coaxial cable 1 comprises two parallel cores 4*a* and 4*b* having inner conductors 2*a* and 2*b* whose outer peripheries are coated with insulations 3*a* and 3*b,* a transversely wound shield 5 provided on outer peripheries of the two cores 4*a* and 4*b,* a metal deposition layer 7 formed on one surface of a plastic tape 6, a composite tape 8 wound around an outer periphery of the transversely wound shield 5 such that the metal deposition layer 7 comes on the side of the transversely wound shield 5, and a jacket 9 coating an outer periphery of the composite tape 8.

Each of the inner conductors 2*a* and 2*b* is a twisted wire conductor comprising one of or a combination of a soft copper wire, a tinned soft copper wire and a silvered copper alloy wire. An outer diameter ϕi of the inner conductor is about 0.013 mm or less. In other words, the outer diameter ϕi of each of the inner conductors 2*a* and 2*b* is 36AWG (American Wire Gauge).

Examples of material of each of the insulations 3*a* and 3*b* are resins selected from polyethylene, polypropylene, ETFE (copolymer of ethylene and tetrafluorethylene), FEP (copolymer of tetrafluorethylene and hexafluoropropylene), PTFE (polytetrafluoroethylene), PFA (copolymer of tetrafluoroethylene and perfluoroalkoxy) and fluorine rubber.

Each of the cores 4*a* and 4*b* may be formed such that any of the above resins is extrude by an extrusion machine or the like in uniform thickness around the outer periphery of the inner conductor 2*a* and 2*b,* or such that a tape made of any of these resin is wound around the outer periphery of the inner conductor 2*a* and 2*b.* An outer diameter ϕc of each of the cores 4*a* and 4*b* is 0.45 mm or less.

The two cores 4*a* and 4*b* arranged in parallel are provided at their outer peripheries with the transversely wound shield 5. The transversely wound shield 5 comprises 30 to 60 strands 5*a,* 5*b,* . . . such as a soft copper wire, a tinned soft copper wire and a silver plated copper alloy wire are transversely wound at a predetermined pitch. A diameter ϕs of each of strands 5*a,* 5*b,* . . . forming the transversely wound shield 5 is about 0.03 mm.

The transversely winding pitch of the transversely wound shield 5 is determined while taking into consideration the following points, i.e., a point that if the transversely winding pitch is large, the continuous slit between strands 5*a,* 5*b,* . . . becomes large, and the shield effect is deteriorated, and a point that if the transversely winding pitch is small, although the slit between strands 5*a,* 5*b,* . . . becomes small, a kink is generated in the cable 1 itself due to tension of strands 5*a,* 5*b,* . . . when they are produced.

More specifically, the transversely winding pitch of the transversely wound shield 5 is in a range expressed by the following equation 1.

$$10 \leqq (\text{transversely winding pitch})/\{(\text{outer diameter of one of said cores})\times 2+(\text{diameter of a transversely wound strand})\} \leqq 20. \quad \text{[Equation 1]}$$

More preferably, the transversely winding pitch of the transversely wound shield 5 is in a range expressed by the following equation 2.

$$12 \leqq (\text{transversely winding pitch})/\{(\text{outer diameter of core})\times 2+(\text{diameter of transversely wound strand})\} \leqq 15 \quad \text{[Equation 2]}$$

The composite tape 8 is wound around the outer periphery of the transversely wound shield 5. The composite tape 8 has the metal deposition layer 7 formed on the one surface of the plastic tape 6 such as polyester. The composite tape 8 is around the outer periphery of the transversely wound shield 5 such that the metal deposition layer 7 comes on the side of the transversely wound shield 5. The metal deposition layer 7 is made of steel or silver for example. A thickness of the metal deposition layer 7 is 0.1 μm or thicker.

The jacket 9 is made of resin selected from PVC (polyvinylchloride), polyethylene, polypropylene, ETFE (copolymer of ethylene and tetrafluorethylene), FEP (copolymer of tetrafluorethylene and hexafluoropropylene), PTFE (polytetrafluoroethylene), PFA (copolymer of tetrafluoroethylene and perfluoroalkoxy) and fluorine rubber.

The jacket 9 is formed such that any of the above resins is extrude by an extrusion machine or the like in uniform thickness around the outer periphery of the composite tape 8. A plastic tape such as polyester may be used as the jacket 9 for example. In this case, the plastic tape is wound around the outer periphery of the composite tape 8 a plurality of times.

An outer diameter ϕ of the two-core parallel extra-fine coaxial cable 1 in its longitudinal direction when the jacket 9 coats is 1.0 mm or less.

The present invention is characterized in that the transversely wound shield is provided around the outer peripheries of the two parallel cores to enhance the flexibility of the cable, and the composite tape formed with the metal deposition layer around the outer periphery of the transversely wound shield to enhance the shield effect.

Next, one example of a producing procedure of the two-core parallel extra-fine coaxial cable 1 will be explained.

First, a silver plated copper alloy wire having an outer diameter ϕi of about 0.09 mm (40AWG) is used as each of the inner conductors 2*a* and 2*b*. A PFA resin insulation is formed by extruding a PFA resin and the PFA resin insulation is coated with the PFA resin, and this is used as each of the insulations 3*a* and 3*b*. The outer peripheries of the inner conductors 2*a* and 2*b* are provided with the insulations 3*a* and 3*b*, thereby forming the cores 4*a* and 4*b* each having the outer diameter ϕc of 0.21 mm. These two cores 4*a* and 4*b* which are insulative wires are arranged in parallel to each other, silver plated copper alloy wires each having strand diameter ϕ of 0.03 mm are transversely wound around the outer peripheries of the two cores 4*a* and 4*b* spirally at a pitch of 6 mm, thereby forming the transversely wound shield 5.

In the present embodiment, since the outer diameter ϕc of the core is 0.21 mm and the diameter ϕs of the transversely wound strand is 0.03 mm, a range of the transversely winding pitch is 4.5 to 9.0 mm from the equation 1 or 2, and more preferably, 5.4 mm to 6.75 mm. Here, the transversely winding pitch is 6 mm, this range satisfies both the conditions of the equations 1 and 2.

A copper deposition polyester tape formed with a copper deposition layer as the metal deposition layer 7 having a thickness of about 0.3 μm formed on the one surface of the polyester tape as the plastic tape 6 is wound around the outer periphery of the transversely wound shield 5 as the composite tape 8 having a thickness of about 4 μm and a width of 2.5 mm. The composite tape 8 is wound such that the copper deposition layer comes on the side of the transversely wound shield 5 and ½ to ⅓ portion of the composite tape 8 is superposed.

If a polyester tape having a thickness of about 6.5 μm and a width of 2.5 mm as the jacket 9 is wound around the outer periphery of the composite tape 8 such that ½ to ⅓ portion of the jacket 9 is superposed, the two-core parallel extra-fine coaxial cable 1 shown in FIGS.1 and 2 is completed. An outer diameter ϕ (outer diameter in the longitudinal direction when coated with the jacket) of the finished cable 1 is about 0.52 mm.

As described above, according to the two-core parallel extra-fine coaxial cable 1 of the present invention, the outer shield is used as the transversely wound shield, and the composite tape formed on one surface with the metal deposition layer is wound around the outer periphery of the transversely wound shield. With this, the shield effect is high and sufficient flexibility for wiring the cable in a narrow space can be provided.

That is, in the two-core parallel extra-fine coaxial cable 1, by using the transversely wound shield as the outer shield, flexibility of cable that is not sufficient when the outer shield is braiding shield or double shield is enhanced. Further, by winding the composite tape formed with the metal deposition layer around the outer periphery of the transversely wound shield, the continuous slit formed between strands of the transversely wound shield is covered, and the shield effect of the cable is enhanced.

The transversely winding pitch of the transversely wound shield is also set such that the shield effect is excellent and the kink is not generated in the cable itself (concretely, as indicated by the equation 1 or 2).

The outer diameter of the finished cable 1 (outer diameter in the longitudinal direction when coated with the jacket) is as thin as 1.0 mm or less, and the flexibility and the shield effect of the cable are sufficient. Therefore, the cable can be wired in a narrow space such as a hinge portion of the notebook personal computer. More particularly, the cable can be used for connecting a notebook personal computer and a liquid crystal display through a hinge portion.

Therefore, the two-core parallel extra-fine coaxial cable 1 has all of the electric characteristics, workability and flexuousity in well balance.

Next, a second embodiment of the present invention will be explained.

Figure 3:
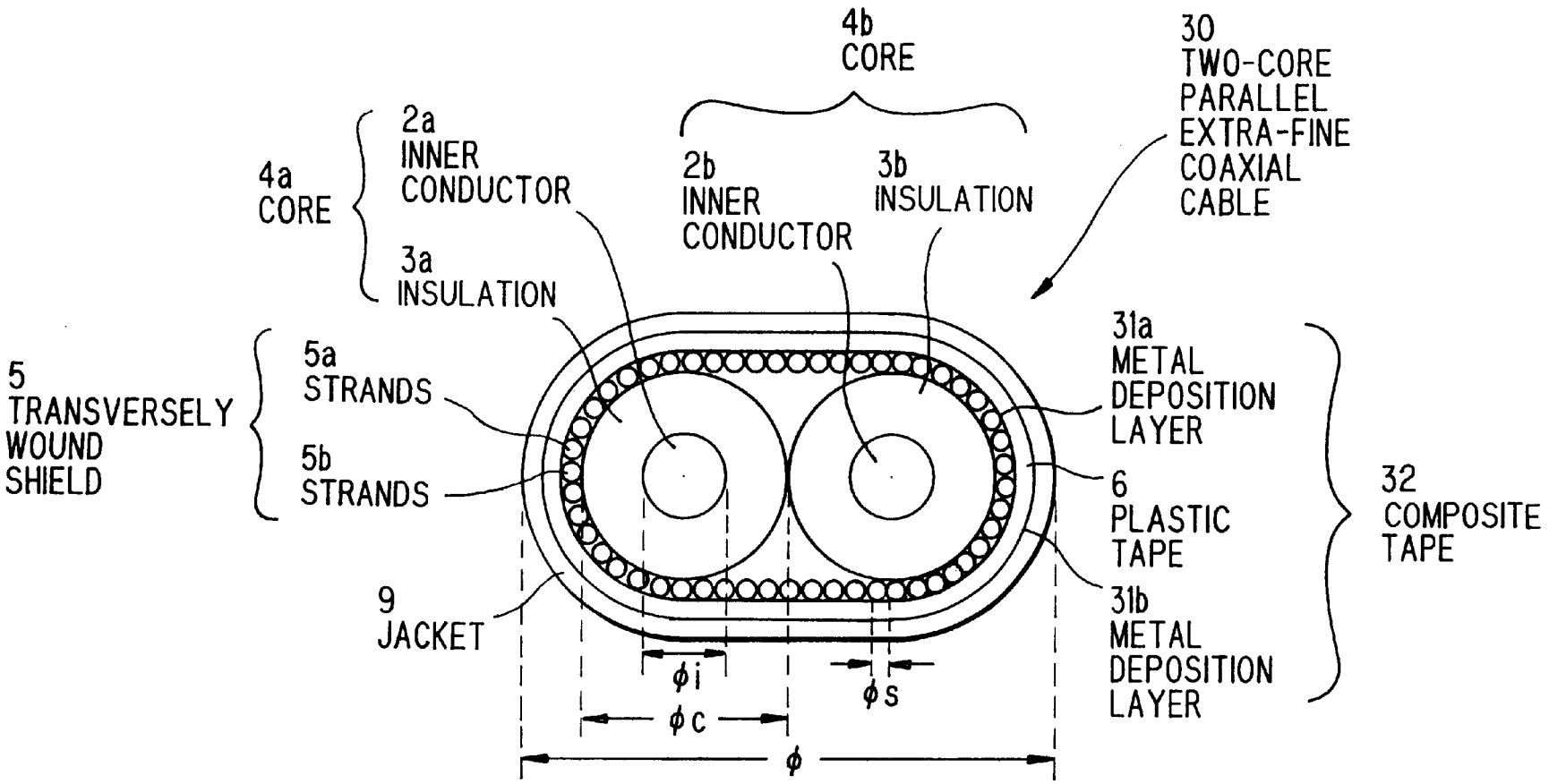
FIG. 3 is a sectional view showing a second embodiment of the invention.
Figure 4:
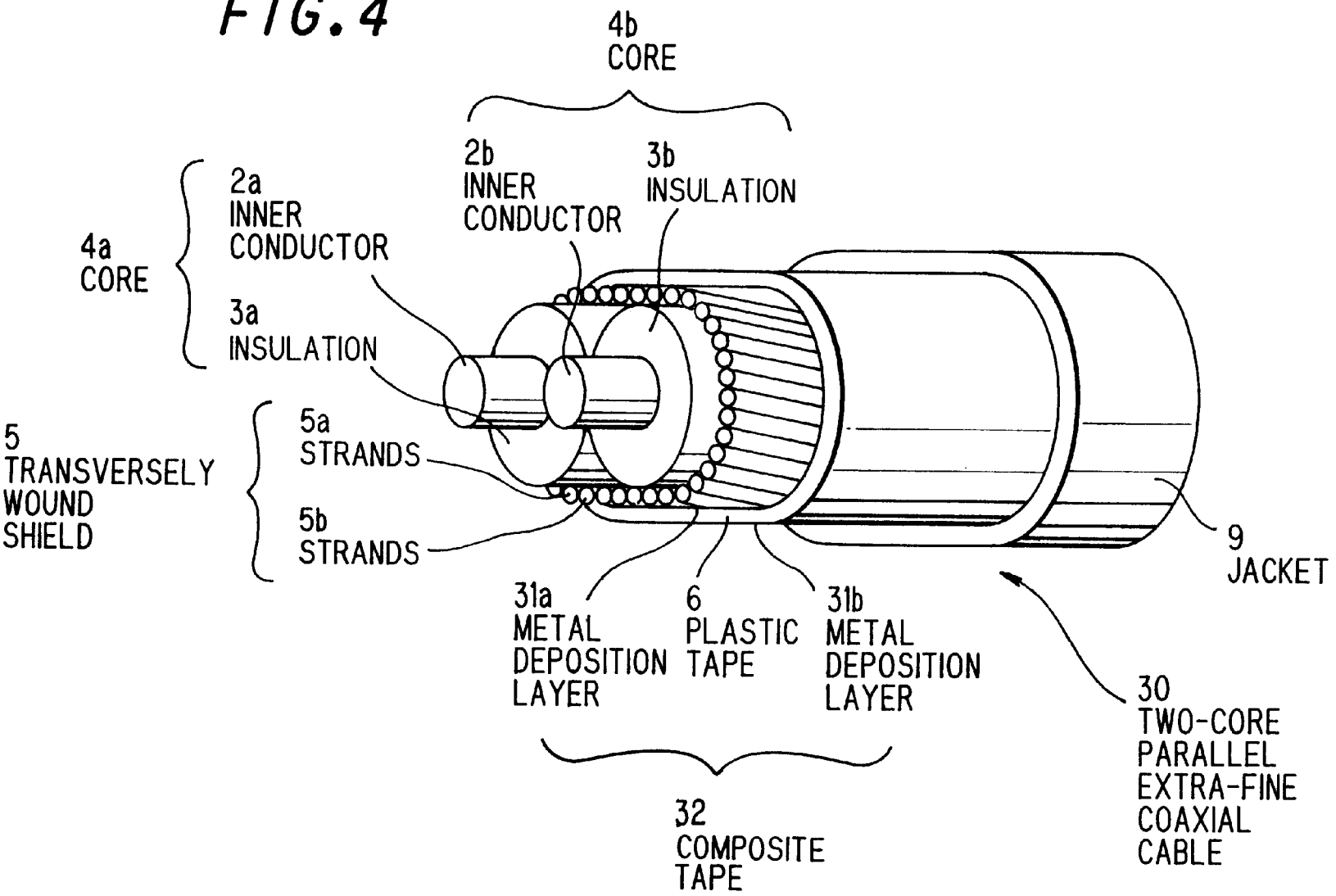
FIG. 4 is a view showing a structure of a two-core parallel extra-fine coaxial cable shown in FIG. 3.

FIG. 3 is a sectional view showing the second embodiment of the invention, and FIG. 4 is a view showing a structure of the two-core parallel extra-fine coaxial cable shown in FIG. 3.

As shown in FIGS.3 and 4, the two-core parallel extra-fine coaxial cable 30 comprises two parallel cores 4*a* and 4*b* having inner conductors 2*a* and 2*b* whose outer peripheries are coated with insulations 3*a* and 3*b*, a transversely wound shield 5 provided on outer peripheries of the two cores 4*a* and 4*b*, a composite tape 32 which has a plastic tape 6 such as polyester formed on its opposite surfaces with metal deposition layer 31*a* and 31*b* and which is wound around the outer periphery of the transversely wound shield 5, and a jacket 9 coating an outer periphery of the composite tape 32.

The metal deposition layer 31*a* and 31*b* are made of copper or silver. A thickness of each of the metal deposition layer 31*a* and 31*b* is set to 0.1 μm or more. This two-core parallel extra-fine coaxial cable 30 has the same structure as that of the two-core parallel extra-fine coaxial cable 1 except the composite tape 32.

In this two-core parallel extra-fine coaxial cable 30, the composite tape 32 formed on its opposite surfaces with the metal deposition layer 31*a* and 31*b* is wound around the outer periphery of the transversely wound shield 5. Therefore, as compared with the cablel, there is merit that the shield effect is further enhanced. Further,when the composite tape 32 is wound around the outer periphery of the transversely wound shield 5, it is unnecessary to check the front and back surfaces and thus, there is a merit that the tape is not erroneously wound. Other working effects are the same as those of the cable 1.

As apparent from the above explanation, according to the present invention, the following excellent effects can be attained. (1) The outer shield is used as the transversely wound shield, and the composite tape formed with the metal deposition layer is wound around the outer periphery of the transversely wound shield. With this, the shield effect is high and sufficient flexibility for wiring the cable in a narrow space can be provided.

Although the invention has been described with respect to specific embodiment for complete and clear disclosure, the appended claims are not to be thus limited but are to be construed as embodying all modification and alternative constructions that may be occurred to one skilled in the art which fairly fall within the basic teaching herein set forth.

What is claimed is:

1. A two-core parallel extra-fine coaxial cable comprising:

two parallel cores having inner conductors whose outer peripheries are coated with insulations, a transversely wound shield provided around the outer peripheries of the two cores, a composite tape which comprises a plastic tape formed on its one surface with a metal deposition layer and which is wound around an outer periphery of the transversely wound shield such that the metal deposition layer comes on the side of the transversely wound shield, and a jacket for coating an outer periphery of the composite tape, wherein a transversely winding pitch of the transversely wound shield is set in accordance with the following equation:

$$10 \leqq (\text{transversely winding pitch})/\{(\text{outer diameter of one of said cores})\times 2+(\text{diameter of a transversely wound strand})\} \leqq 20.$$

2. A two-core parallel extra-fine coaxial cable according to claim 1, wherein an outer diameter of each inner conductor of the core is about 0.13 mm or less, an outer diameter of the core is 0.45 mm or less, and an outer diameter of the cable when coated with the jacket is 1.0 mm or less.

3. A two-core parallel extra-fine coaxial cable according to claim 1, wherein the transversely wound shield is formed by winding 30 to 60 strands comprising any of a soft copper wire, a tinned soft copper wire and a silver plated copper alloy wire around the outer peripheries of the two parallel cores.

4. A two-core parallel extra-fine coaxial cable according to claim 1, wherein a diameter of each of strands forming the transversely wound shield is about 0.03 mm.

5. A two-core parallel extra-fine coaxial cable according to claim 1, wherein the metal deposition layer formed on the composite tape is made of silver or copper, and a thickness of the metal deposition layer is 0.1 $\mu$m or more.

6. A two-core parallel extra-fine coaxial cable comprising:

two parallel cores having inner conductors whose outer peripheries are coated with insulations, a transversely wound shield provided around the outer peripheries of the two cores, a composite tape which comprises a plastic tape formed on its opposite surfaces with metal deposition layers and which is wound around an outer periphery of the transversely wound shield, and a jacket for coating an outer periphery of the composite tape, wherein a transversely winding pitch of the transversely wound shield is set in accordance with the following equation:

$$10 \leqq (\text{transversely winding pitch})/\{(\text{outer diameter of one of said cores})\times 2+(\text{diameter of a transversely wound strand})\} \leqq 20.$$

7. A two-core parallel extra-fine coaxial cable according to claim 6, wherein an outer diameter of each inner conductor of each core is about 0.13 mm or less, an outer diameter of each core is 0.45 mm or less, and an outer diameter of the cable when coated with the jacket is 1.0 mm or less.

8. A two-core parallel extra-fine coaxial cable according to claim 6, wherein the transversely wound shield is formed by winding 30 to 60 strands comprising any of a soft copper wire, a tinned soft copper wire and a silver plated copper alloy wire around the outer peripheries of the two parallel cores.

9. A two-core parallel extra-fine coaxial cable according to claim 6, wherein a diameter of each of strands forming the transversely wound shield is about 0.03 mm.

10. A two-core parallel extra-fine coaxial cable according to claim 6, wherein the metal deposition layer formed on the composite tape is made of silver or copper, and a thickness of the metal deposition layer is 0.1 $\mu$m or more.

* * * * *